US007540038B2

(12) United States Patent
Li

(10) Patent No.: US 7,540,038 B2
(45) Date of Patent: Jun. 2, 2009

(54) METHOD FOR MANUFACTURING AN INDUSTRIAL GLOVE

(76) Inventor: Peng-Hui Li, 235 Chung-Ho Box 8-24, Taipei (TW)

( * ) Notice: Subject to any disclaimer, the term of this patent is extended or adjusted under 35 U.S.C. 154(b) by 44 days.

(21) Appl. No.: 11/503,055

(22) Filed: Aug. 14, 2006

(65) Prior Publication Data

US 2008/0034472 A1 Feb. 14, 2008

(51) Int. Cl.
*A41D 19/00* (2006.01)

(52) U.S. Cl. ..... 2/161.1

(58) Field of Classification Search ..... 2/16, 2/20, 161.1, 161.6
See application file for complete search history.

(56) References Cited

U.S. PATENT DOCUMENTS 2,060,961 A * 11/1936 Tillotson ..... 427/288
4,445,232 A * 5/1984 Nelson ..... 2/16
4,519,098 A * 5/1985 Dunmire et al. ..... 2/161.8
4,536,890 A * 8/1985 Barnett et al. ..... 2/164
5,070,540 A * 12/1991 Bettcher et al. ..... 2/2.5
6,591,427 B1 * 7/2003 Bennett ..... 2/161.8
2001/0008672 A1 * 7/2001 Norvell et al. ..... 428/90
2002/0112272 A1 * 8/2002 Culler et al. ..... 2/161.6

* cited by examiner

*Primary Examiner*—Katherine Moran

(57) ABSTRACT

A method for manufacturing an industrial glove comprises the step of knitting a glove body; coating a first enhancing layer upon a palm portion and an inner surface of an arm portion of the glove body; installing the glove body upon a hand mold; adhering liquid rubber upon the glove body so as to form an outer rubber layer; and drying the glove body. Furthermore, an industrial glove is provided. The glove comprises a glove body formed by knitting; a first enhancing layer upon a palm portion and an inner surface of an arm portion of the glove body; and an outer rubber layer coated upon the glove body.

9 Claims, 8 Drawing Sheets

METHOD FOR MANUFACTURING AN INDUSTRIAL GLOVE

FIELD OF THE INVENTION

The present invention relates to gloves, and in particular to a method for manufacturing an industrial glove and the glove manufactured from the method, in that a palm portion and arm portion are adhered with an enhancing layer.

BACKGROUND OF THE INVENTION

Conventionally, in manufacturing of a glove, an inner cotton layer is formed by knitting. The inner cotton layer is placed upon a hand mold, and then is sunk in rubber liquid to form an outer rubber layer so that the glove has preferred grapping effect. The inner cotton layer provides a comfortable feeling to hand.

The prior art outer rubber layer cannot provide suffice grapping force. In one improvement, an industrial glove is provided. In that, an inner cotton layer is formed by knitting. The inner cotton layer is placed upon a hand mold, and then is sunk in rubber liquid to form an outer rubber layer. The feature of this improvement is that the fingers of the inner cotton layer are seamed with web layers. When the glove body is sunk in rubber liquid, the web layer absorbs more rubber so that the thickness has an increment of 20 to 30% than other portion. Thereby the finger portions of the outer rubber layer are textured so as to provide preferred grapping ability.

However in this prior art, the enhancing portion is only confined at the finger portion. However holding a heavy burden, the palm and arm of the glove body will suffer from a great force, but above mentioned glove body cannot provide sufficient grapping force so that the glove will be destroyed as it is used for a long time.

SUMMARY OF THE INVENTION

Accordingly, the primary object of the present invention is to provide a method for manufacturing an industrial glove and the glove manufactured from the method, in that a palm portion and arm portion are adhered with an enhancing layer.

In the manufacturing of the industrial glove of the present invention, the conventional fabric glove is added with an enhancing layer which a shape and size matching to the fabric glove. The enhancing layer is extended from the palm portion to the arm portion. The fabric glove is added with an enhancing layer. After it is glued, the portion having the enhancing layer will be formed with coarse surface with a shape identical to the enhancing layer so as to increase the grasping force of the glove as grasping an object and the glove can be used for a long time and the ability of pierce-preventing is increased.

To achieve above objects, the present invention provides a method for manufacturing an industrial glove which comprises the steps of knitting a glove body; coating a first enhancing layer upon a palm portion and an inner surface of an arm portion of the glove body; installing the glove body upon a hand mold; adhering liquid rubber upon the glove body so as to form an outer rubber layer; and drying the glove body.

Furthermore in the present invention, other than web-like structure, the enhancing layer may have any other structure or made of any other material, such as made of fine web like cloth or coarse web like cloth or flat fabric cloth, etc. All these are suitable as the materials of enhancing layers.

Furthermore in the present invention, other than distributing on the palm portion of the glove, the present invention can be covered to the backside of the glove. Thereby, the palm and arm portions of the glove can be made to be two different materials.

Moreover the present invention provides an industrial glove which comprises a glove body formed by knitting; a first enhancing layer upon a palm portion and an inner surface of an arm portion of the glove body; and an outer rubber layer coated upon the glove body.

The first enhancing layer is adhered upon the glove body by adhesive and an edge of the first enhancing layer is knitted to the glove body.

The material of the first enhancing layer is selected from one of Nylon and spandex; polyester, kevlar and other man-made fiber cloth.

A second enhancing layer is adhered around an opening of the glove body.

The second enhancing layer around the opening has a material different from the first enhancing layer.

The material of the outer rubber layer is selected from Polyvinyl chloride, (PVC), Natrue Bubber (NR), Polychloroprene (CR), and Nitrile-butadiene Rubber (NBR).

The first enhancing layer is adhered upon the glove body by adhesive and an edge of the first enhancing layer is knitted to the glove body.

The enhancing layer has a web structure.

The material of the first enhancing layer is selected from one of Nylon and spandex; polyester, kevlar and other man-made fiber cloth.

The second enhancing layer around the opening has a shape different from the first enhancing layer.

A back side of the glove body is adhered with a third enhancing layer.

The various objects and advantages of the present invention will be more readily understood from the following detailed description when read in conjunction with the appended drawing.

DETAILED DESCRIPTION OF THE INVENTION

In order that those skilled in the art can further understand the present invention, a description will be provided in the following in details. However, these descriptions and the appended drawings are only used to cause those skilled in the art to understand the objects, features, and characteristics of the present invention, but not to be used to confine the scope and spirit of the present invention defined in the appended claims.

Figure 1:
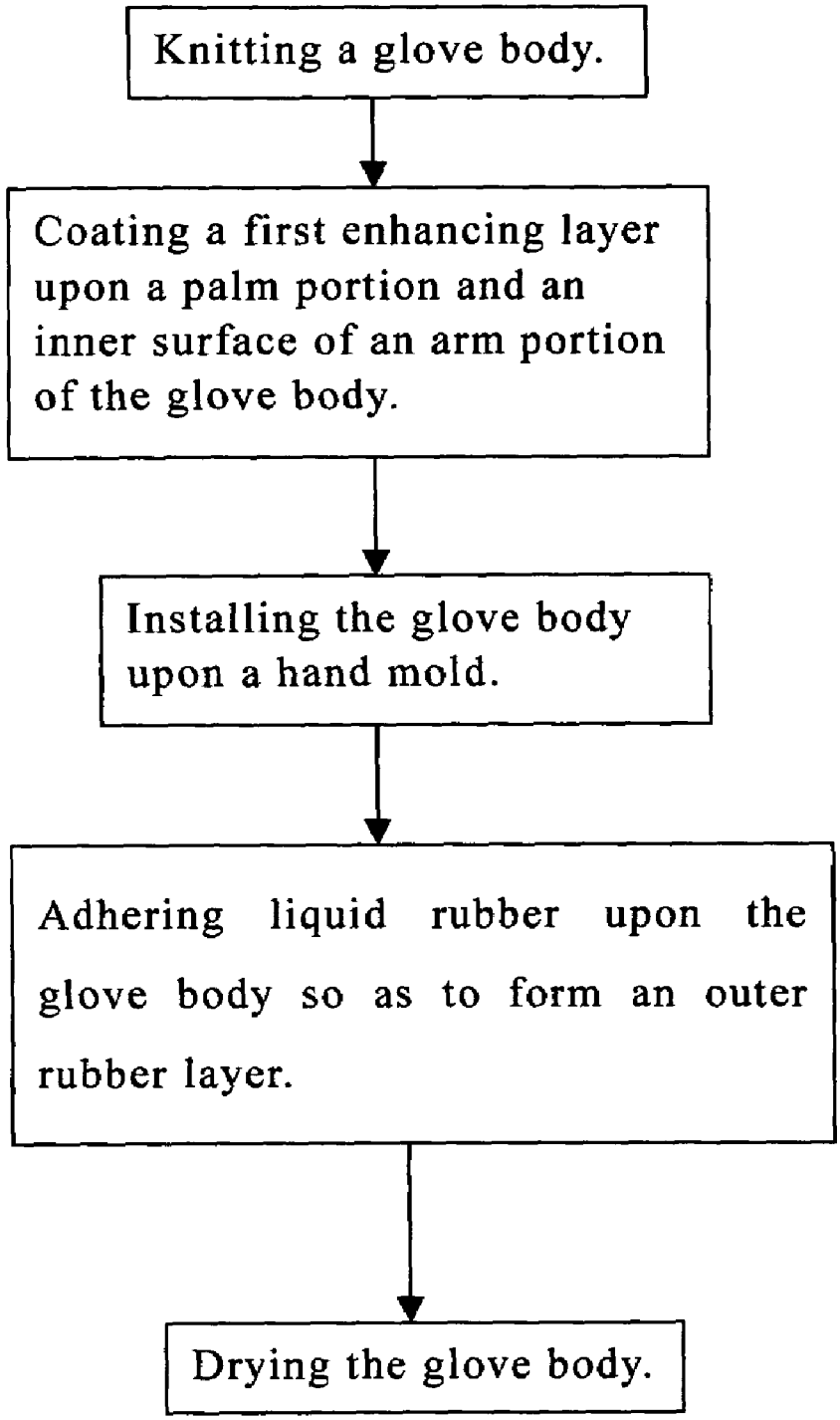
FIG. 1 shows the manufacturing process of the present invention.
Figure 2:
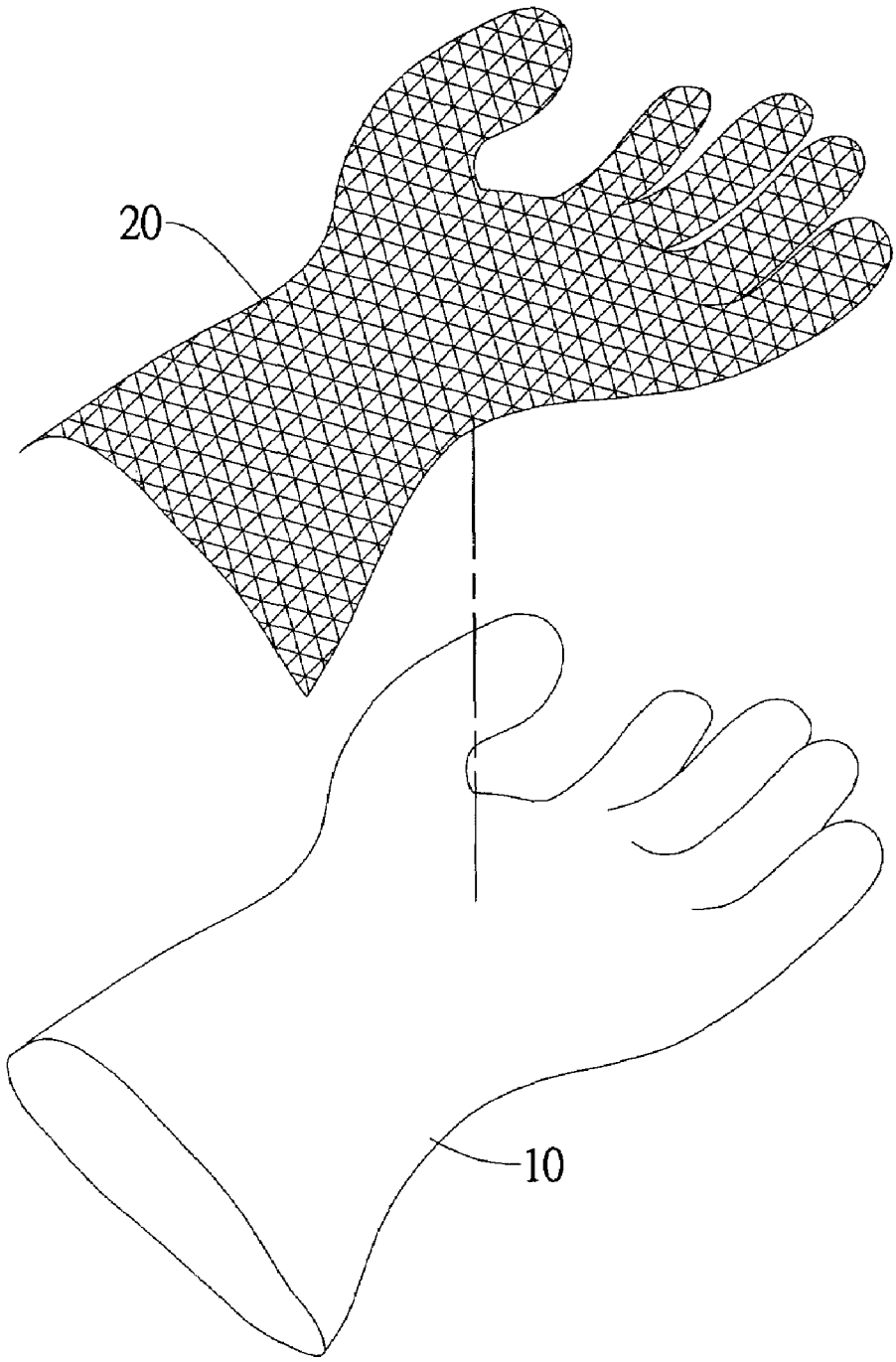
FIG. 2 shows an exploded view of the present invention, wherein the glove body and the enhancing layer are illustrated.
Figure 3:
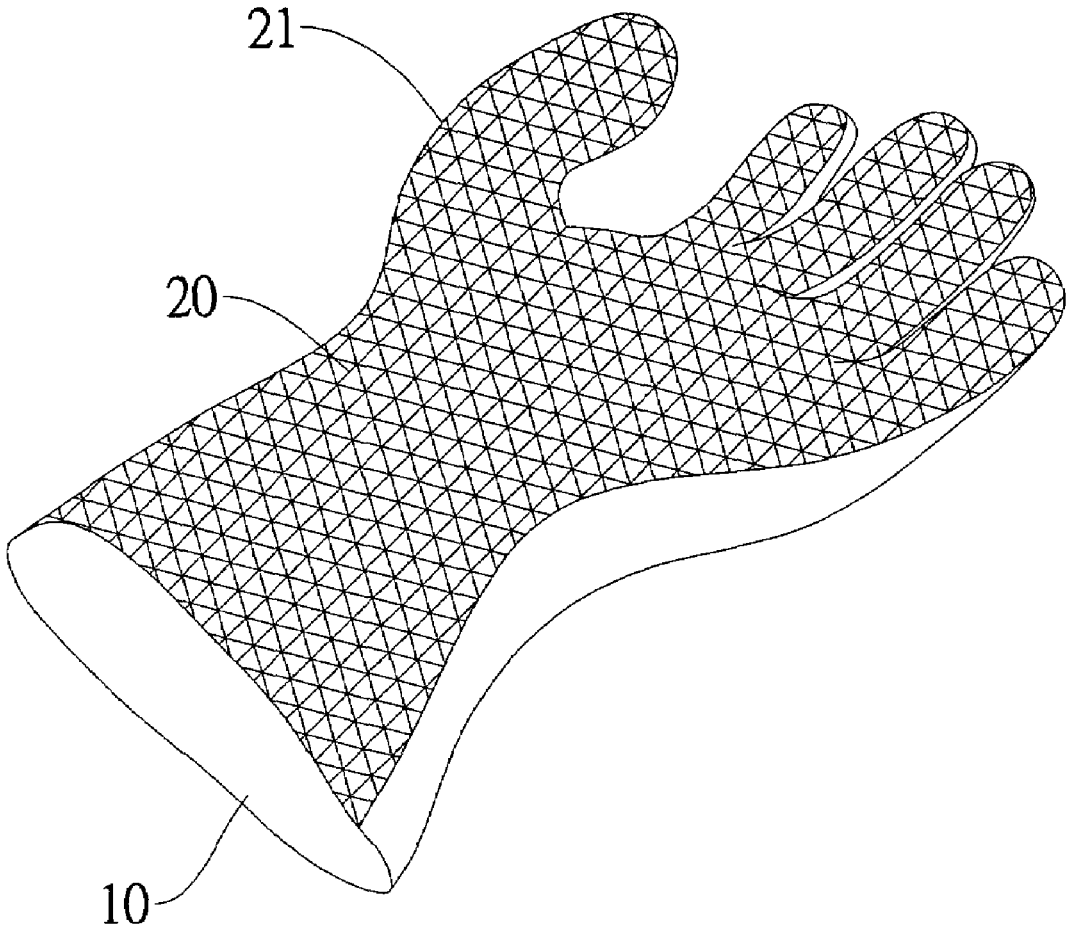
FIG. 3 shows the connection of the glove body and the enhancing layer of the present invention.

Referring to FIGS. 2 to 3, the manufacturing method of the present invention is illustrated.

A glove body 10 is formed by knitting, an enhancing layer 20 is adhered to an palm portion and an inner arm portion of the body 10. An outer rubber layer 30 is adhered upon the enhancing layer 20 by placing the body 10 upon a hand mold.

Referring to FIG. 2, it is illustrated that a glove body 10 is formed by knitting. An enhancing layer 20 is adhered upon the palm portion and inner arm portion of the body 10. Referring to FIG. 3, it is illustrated that the enhancing layer 20 is adhering to the body 10 by adhesive. An edge of the enhancing layer 20 is seamed to the body 10. In the present invention, the edge of the enhancing layer 20 can be seamed to the edge of the glove body 10.

Figure 4:
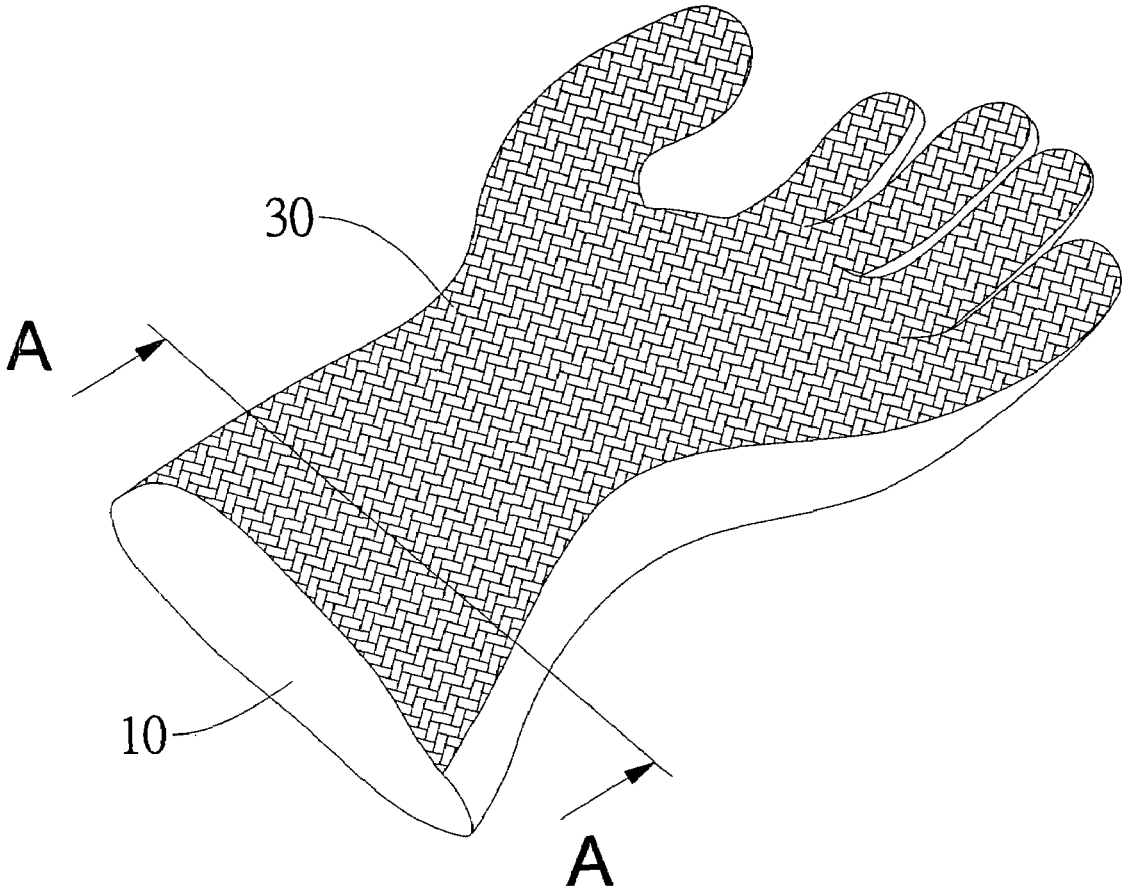
FIG. 4 shows a perspective view of the present invention.

When the body 10 is combined with the enhancing layer 20, then they are sunk in liquid rubber. Then the structure is dried so as to form an outer rubber layer 30. With reference to FIG. 4, in the present invention, the material of the outer rubber layer 30 may be selected from Polyvinyl chloride (PVC), Nature Rubber (NR), Polychloroprene (CR) and Nitrile-butadiene Rubber (NBR) and mixing units of high molecular materials.

The enhancing layer 20 has a web structure. It may have other suitable shape. The material of the enhancing layer 20 may be selected from; NYLON and SPANDEX; or POLYESTER, or KEVLAR or other manmade fiber cloth.

Figure 5:
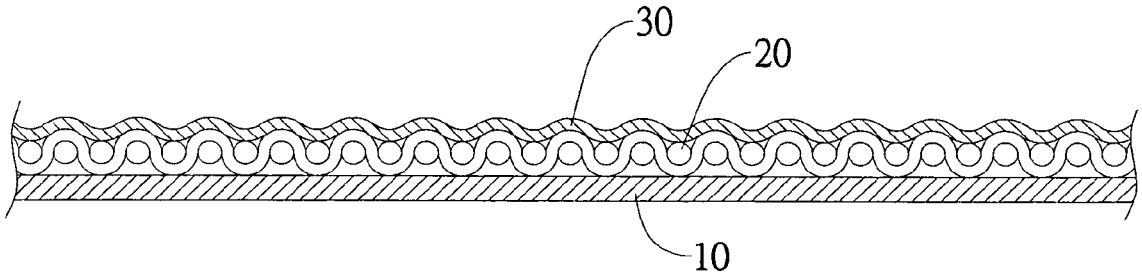
FIG. 5 is a cross sectional view along line AA of FIG. 3.

Besides, referring to FIG. 5, since the enhancing layer 20 is connected to the body 10, the outer rubber layer 30 will be formed as a coarse surface so as to have preferred grapping effect. The enhancing layer 20 has the effect of increasing the endurance of the glove.

Figure 6:
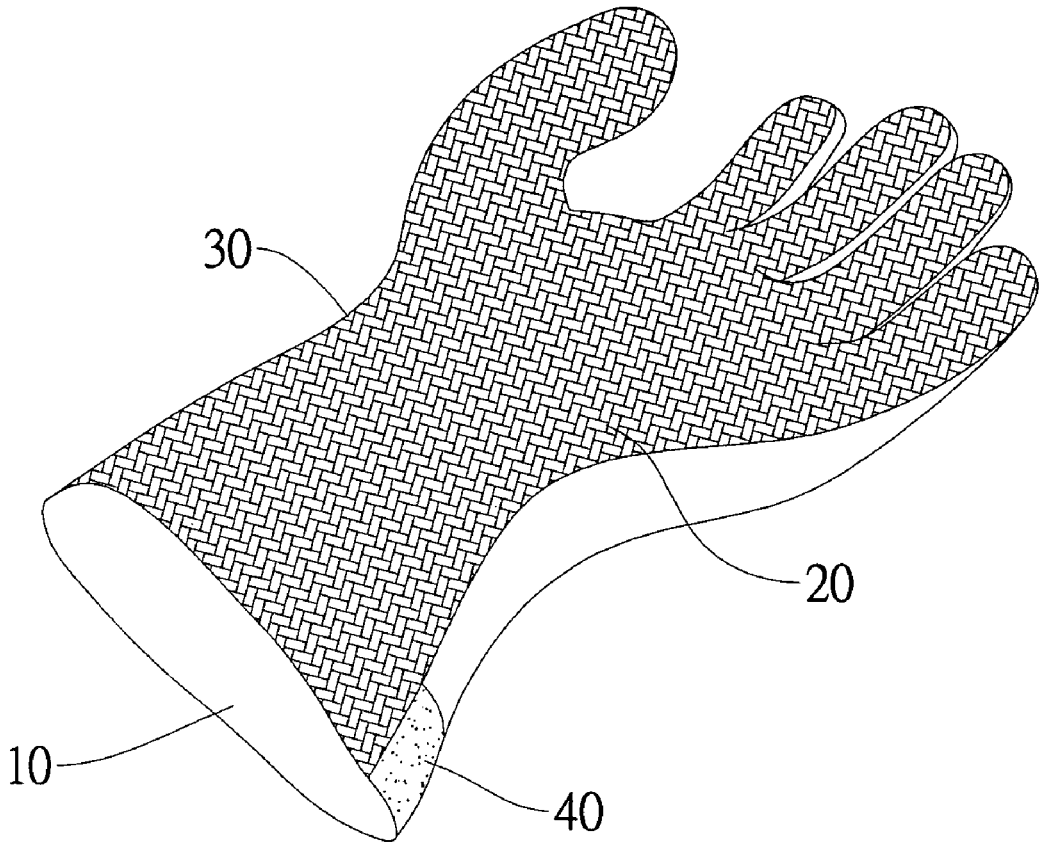
FIG. 6 shows a perspective view of another embodiment of the present invention.

Furthermore, other than the web structure as illustrated in FIGS. 2 and 4, the enhancing layer 20 of the present invention can be formed by coarse web cloth, fine web cloth, and flat knitting cloth. Furthermore, in the present invention, the back of the hand can be seamed with the enhancing layer 20 so that the whole structure of the glove is enhanced. Furthermore, the palm portion and the opening of the glove may be made with different materials. With reference to FIG. 6, the knitting glove body 10, other than the coarse outer rubber layer 30, is added to the palm portion and the inner arm portion, a backside of the arm portion is added with another enhancing layer 40 which is made of material different from that used in the enhancing layer 20.

Figure 7:
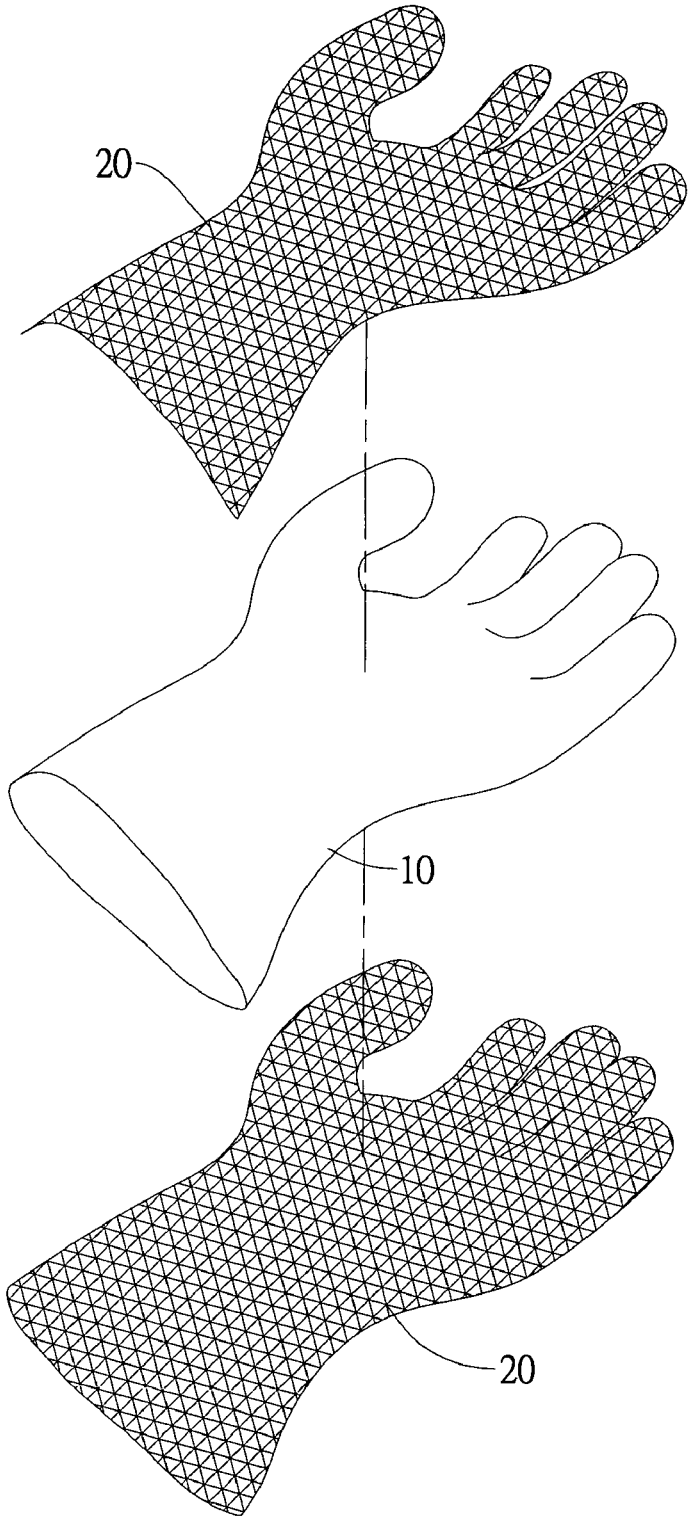
FIG. 7 is an exploded view of a further embodiment of the present invention, wherein the front and back sides of the glove body are added with enhancing layers.
Figure 8:
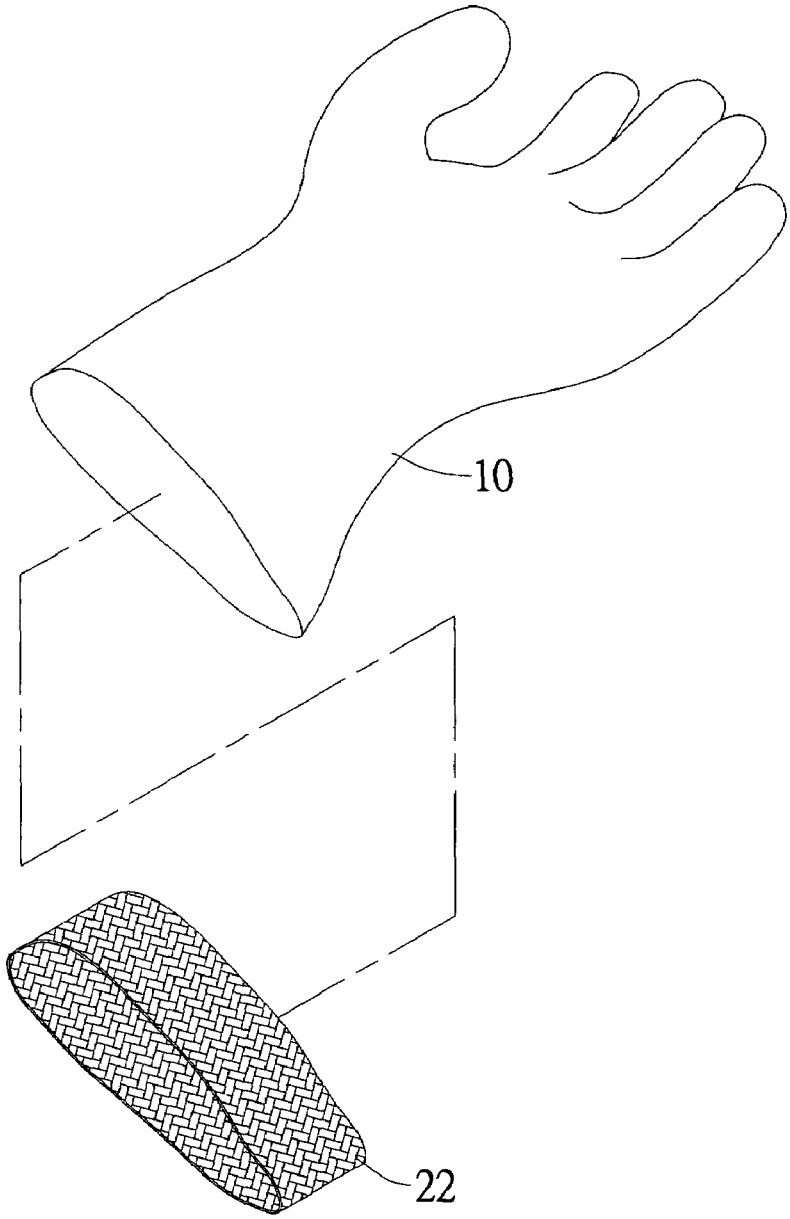
FIG. 8 shows a yet embodiment of the present invention, wherein the enhancing layer is only added at the opening portion of the glove body.

With reference to FIG. 7, it is illustrated that the backside of the glove body 10 is added with another enhancing layer 20. Referring to FIG. 8, it is illustrated that the enhancing layer 20 is only added at the opening of arm portion of the glove body 10. The second enhancing layer around the opening has a material different from the first enhancing layer.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A method for manufacturing an industrial glove comprising:

knitting a glove body; said glove body including a palm portion, a backside portion, five finger portions, and an arm portion;

coating a first enhancing layer upon a palm portion; an inner surface of an arm portion of the glove body and five finger portions;

installing the glove body upon a hand mold;

adhering liquid rubber upon the glove body so as to form an outer rubber layer; and drying the glove body; and wherein the first enhancing layer is adhered upon the glove body by adhesive and an edge of the first enhancing layer is knitted to the glove body;

wherein a second enhancing layer is adhered around an opening of the glove body to be formed as a closed ring enclosing the opening; and wherein the second enhancing layer around the opening has a material different from the first enhancing layer.

2. The method for manufacturing an industrial glove as claimed in claim 1, wherein the material of the first enhancing layer is selected from one of Nylon and spandex; polyester, kevlar and other manmade fiber cloth.

3. The method for manufacturing an industrial glove as claimed in claim 1, wherein the material of the outer rubber layer is selected from Polyvinyl chloride (PVC), Nature Rubber (NR), Polychloroprene (CR), and Nitrile-butadiene Rubber (NBR), and mixture of high molecular materials.

4. An industrial glove comprising:

a glove body formed by knitting; said glove body including a palm portion, a backside portion, five finger portions, and an arm portion;

a first enhancing layer upon a palm portion; an inner surface of an arm portion of the glove body and five fingers; and an outer rubber layer coated upon the glove body; and - wherein the first enhancing layer is adhered upon the glove body by adhesive and an edge of the first enhancing layer is knitted to the glove body;

wherein a second enhancing layer is adhered around an opening of the glove body to be formed as a closed ring enclosing the opening; and wherein the second enhancing layer around the opening has a material different from the first enhancing layer.

5. The industrial glove as claimed in claim 4, wherein the enhancing layer has a web structure.

6. The industrial glove as claimed in claim 4, wherein the material of the first enhancing layer is selected from one of Nylon, spandex; polyester, kevlar and other manmade fiber cloth.

7. The industrial glove as claimed in claim 4, wherein the second enhancing layer around the opening has a shape different from the first enhancing layer.

8. The industrial glove as claimed in claim 4, wherein the glove body is adhered with a third enhancing layer.

9. The method for manufacturing an industrial glove as claimed in claim 4, wherein the material of the outer rubber layer is selected from Polyvinyl chloride, (PVC), Nature Rubber (NR), Polychloroprene (CR), and Nitrile-butadiene Rubber (NBR), and mixture of high molecular materials.

* * * * *